US006761627B2

(12) United States Patent
Abe et al.

(10) Patent No.: US 6,761,627 B2
(45) Date of Patent: Jul. 13, 2004

(54) COIN DISPENSING APPARATUS WITH REMOVABLE AUXILIARY STORAGE UNIT

(75) Inventors: Hiroshi Abe, Saitama-ken (JP); Masayoshi Umeda, Saitama-ken (JP)

(73) Assignee: Asahi Seiko Co., Ltd., Tokyo (JP)

( * ) Notice: Subject to any disclaimer, the term of this patent is extended or adjusted under 35 U.S.C. 154(b) by 170 days.

(21) Appl. No.: 10/213,318

(22) Filed: Aug. 6, 2002

(65) Prior Publication Data

US 2003/0032387 A1 Feb. 13, 2003

(30) Foreign Application Priority Data

Aug. 8, 2001 (JP) ..... 2001-240000

(51) Int. Cl.[7] ..... G07D 1/00
(52) U.S. Cl. ..... 453/56
(58) Field of Search ..... 453/56, 39, 49, 453/63, 57

(56) References Cited

U.S. PATENT DOCUMENTS 3,361,141 A * 1/1968 Weisskopf ..... 453/11
4,535,794 A * 8/1985 Bellis et al. ..... 453/56
5,190,495 A 3/1993 Taxon ..... 453/32

FOREIGN PATENT DOCUMENTS

GB 2.172.613 A * 1/1985 ..... G07D/1/00
JP 4-340695 A * 11/1992 ..... G07D/9/00

* cited by examiner

*Primary Examiner*—Donald P. Walsh
*Assistant Examiner*—Mark J. Beauchaine

(57) ABSTRACT

A coin dispensing apparatus is provided with a coin hopper for storing coins and a coin dispenser operatively connected to the coin hopper for selectively dispensing coins from the coin hopper. An auxiliary bowl assembly for storing coins includes a coin transporter unit for removing coins from the auxiliary bowl assembly and transporting the coins to the coin hopper. The coin hopper can deliver overflow coins to the auxiliary bowl assembly. The coin transporter unit can comprise a plurality of block members pivotally connected to form an endless loop member for transporting coins and flexibly mounted within the auxiliary bowl assembly. A position adjusting device permits a removable sliding of the auxiliary bowl assembly to an operative position adjacent to the coin hopper.

11 Claims, 10 Drawing Sheets

COIN DISPENSING APPARATUS WITH REMOVABLE AUXILIARY STORAGE UNIT

BACKGROUND OF THE INVENTION

1. Field of the Invention

The present invention is directed to a coin dispensing device, and more particularly to an addition of an auxiliary bowl assembly that can be removably attached for storing and transporting coins from and to a main coin hopper.

2. Description of Related Art

Coin dispensing apparatuses are frequently utilized in a large number of gaming machines, automatic ticket dispensers, change devices, etc. It has been known to provide auxiliary storage for a coin hopper with coins, that overflow from the main coin hopper, being deposited into an auxiliary storage unit and dependent on the amount of coins stored in the main coin hopper utilizing a coin transporting device to return coins to the main coin hopper. Generally, the overflow of coins are stored in an auxiliary storage unit which is located below the main coin hopper so that coins will overflow, as shown for example in the Japanese Laid Open Publication No. HEI07-595.

When there is a high volume of coin exchange, for example in gaming machines, it can be labor intensive to remove coins and recharge not only the main coin hopper, but also an auxiliary storage unit that is operatively connected with the main coin hopper. If the coins are exhausted, the gaming machine becomes inoperative. Thus, for example, in a casino or other gaming establishment, service personnel must frequently monitor the status of coins in the gaming machines.

Thus, there is a demand to increase the efficiency of the operation of a coin dispensing apparatus, such as a gaming machine, wherein a large volume of coins are both received and discharged during operation.

SUMMARY OF THE INVENTION

The present invention provides a coin dispensing apparatus that can be installed, for example in a gaming machine or other coin related device. A coin hopper is provided for storing coins and a coin dispenser is operatively connected to the coin hopper for selectively dispensing coins from the coin hopper during the operation of the vending or gaming machine. An auxiliary bowl assembly is operatively positioned adjacent the coin hopper for receiving overflowing coins from the coin hopper and for returning or transporting coins back to the coin hopper. A position-adjusting device for removably mounting the auxiliary bowl assembly is provided to enable the service personnel to empty coins and, if necessary, readily replace one auxiliary bowl assembly with another auxiliary bowl assembly that can be appropriately charged with a supply of coins. Thus, the housing of the vending machine or gaming machine can be accessed and an auxiliary bowl assembly can be mounted, for example on a channel and rail to permit an aligned sliding movement of the auxiliary bowl assembly to and from an operative position adjacent the coin hopper. The auxiliary bowl assembly can include an appropriate coupling for receiving a motive force to drive a coin transport device to lift coins from the bottom of the auxiliary bowl assembly for transport to the coin hopper. The auxiliary bowl assembly can include a guiding groove to receive an appropriate guide pin from a coin transporter unit having a plurality of crawler block members pivotally connected to form an endless loop member for transporting the coins. One side of each crawler block member can have indentations, such as teeth, that can be appropriately driven, while the other side can have a coin engaging surface. The block members can be formed of a molded plastic, and can be at least partially supported by a flexible support member mounted within the auxiliary bowl assembly for supporting the endless loop member. An exit chute can be provided at the upper portion of the auxiliary bowl assembly, which can match with a complementary aperture on a sidewall of the coin hopper for accepting coins from the exit chute.

Thus, overflow coins from the coin hopper can be appropriately stored in the auxiliary bowl member and can be recovered from the auxiliary bowl member by a self-contained transport device within the auxiliary bowl member. Accordingly, the auxiliary bowl assembly can be easily mounted within, for example a gaming machine and coins can be easily recovered from the auxiliary bowl member. The auxiliary bowl assembly can be mounted adjacent to the base of the coin hopper to permit a sliding movement as the auxiliary bowl assembly is moved to an operative position within the gaming machine. As can be appreciated, the auxiliary bowl assembly, when removed from the gaming machine, can be easily inverted so that the coins can be removed from the auxiliary bowl assembly.

The coin transporting device can be formed of a plurality of pivotally mounted crawler blocks that can be easily molded and assembled to be relatively inexpensive.

The coin transporter device can carry coins on the inner surface of the crawler blocks and thereby permit overflow coins to be introduced into the auxiliary bowl assembly on a periphery, thereby falling by gravity to the lowest point of the coin transporter device. Thus, the coins do not interfere with the upper movement of the transported coins back to the coin hopper during an overflow. The overflow coins are directed by a channel or chute so that the coins are smoothly introduced into the auxiliary bowl assembly, while minimizing the wear on the coin transporting device.

DETAILED DESCRIPTION OF THE PREFERRED EMBODIMENT

The following description is provided to enable any person skilled in the art to make and use the invention and sets forth the best modes contemplated by the inventors of carrying out their invention.

Figure 1:
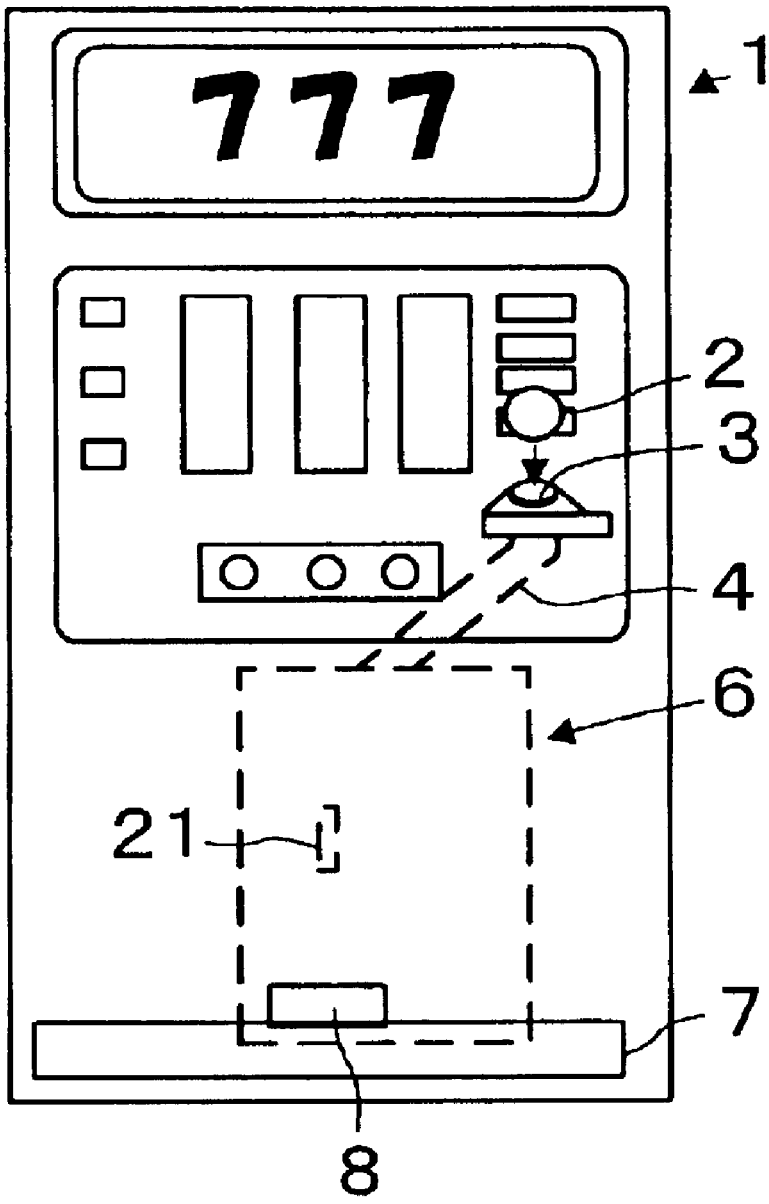
FIG. 1 is a front elevational schematic of a gaming machine which can accommodate the coin dispensing apparatus of the present invention.
Figure 2:
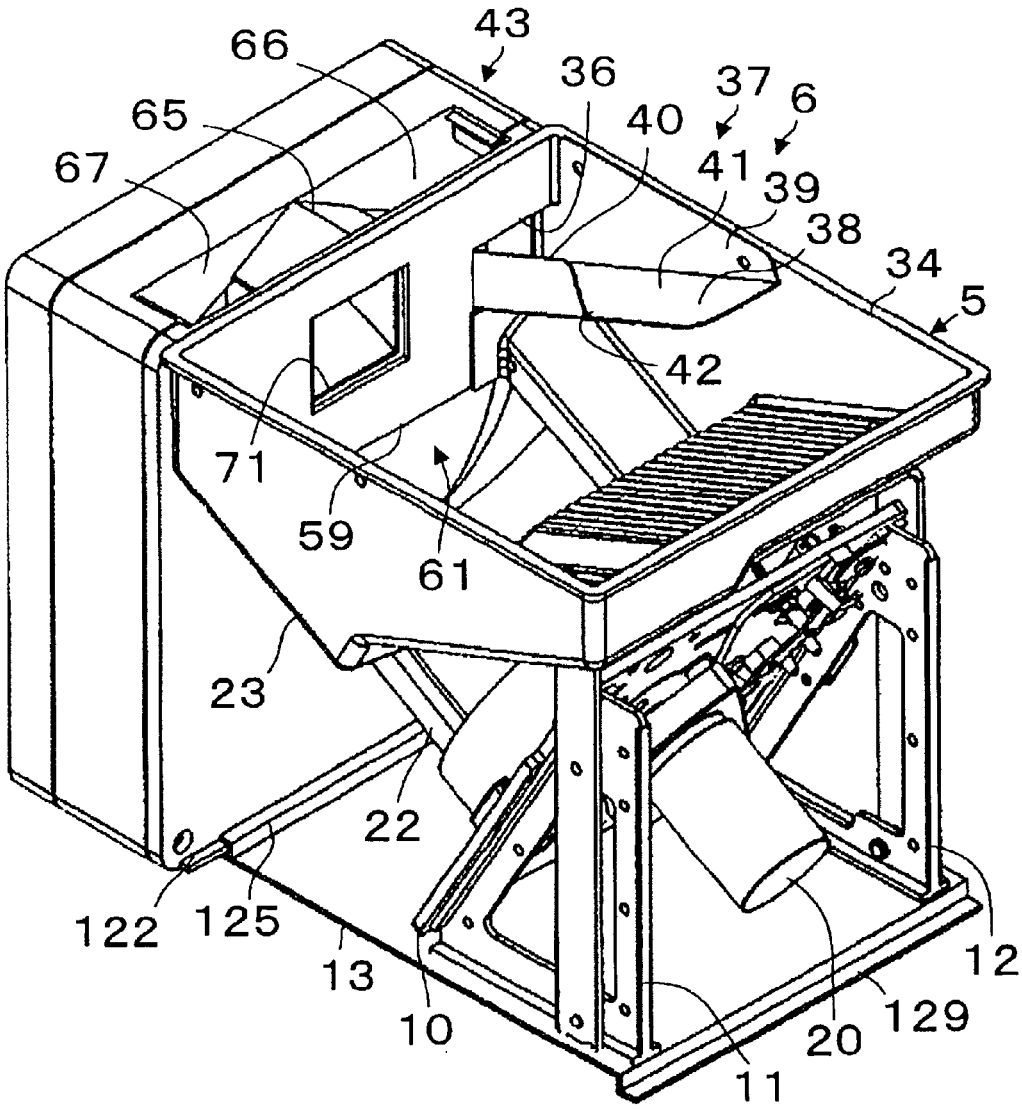
FIG. 2 is a perspective view of the coin dispensing apparatus of the present invention.
Figure 7:
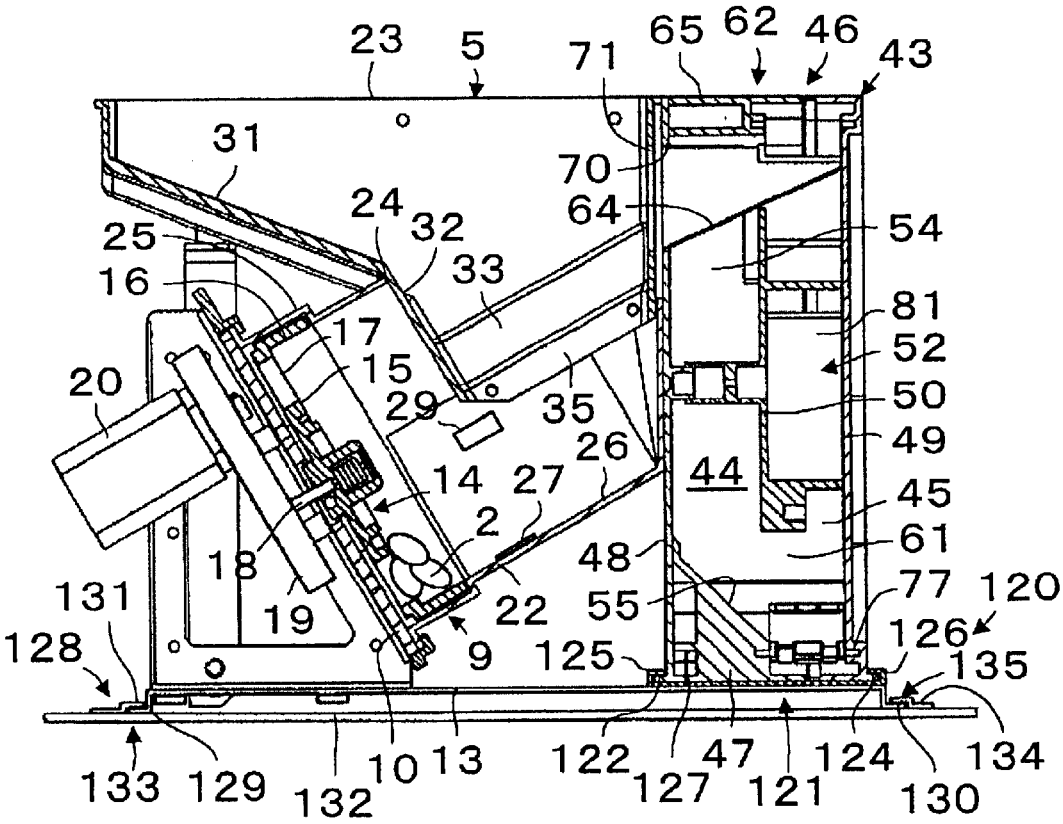
FIG. 7 is a cross-sectional view taken along the line x—x of FIG. 5.

Referring to FIG. 1, an example of a gaming machine 1 that can incorporate the coin dispensing apparatus 6 of the present invention is disclosed. A coin 2, which for purposes of the present invention, can be a medallion, monetary coin, token, etc. as known in the field, can be deposited within a slot and then during its travel it will pass through a selector 3 to determine if it is a genuine token or coin. A genuine coin is then guided, as known in the art, to the storing bowl 5 of a coin hopper 6 through a chute 4 as shown in FIG. 2. During the playing of the gaming machine 1, if a player wins a game, then a predetermined number of coins are dispensed to the tray 7 from a dispensing slot 8. As shown in FIG. 7, the storing bowl can include a coin dispenser operatively connected to the coin hopper 6 for selectively dispensing the coins to pay off the winning pre-determined number of coins.

A supporting board, as shown in FIG. 7, is fixed to a frame 11 and 12 which are triangular and fixed at the ends of a plane board 13. The supporting board 10 is rectangular and is slanted at a 60 degree angle from the plane board 13 for supporting the coin dispenser 9.

The coin dispenser 9 includes a rotating disc 14 of a cylindrical configuration with a base that includes the bottom board 15 and flange 16 which is located at the rim of the bottom board 15. A number of apertures or holes 17, such as eight, are located at the bottom board 15 at equally spaced distances. The rotating disc 14 is connected to a shaft 18 which is in turn connected to a reduction gear assembly that is fixed on the rear of the supporting board 10. An electric first motor 20 is capable of driving the reducing gear assembly to appropriately rotate the rotating disc 14.

When the rotating disc 14 rotates, coins 2 that contact the rotating disc 14 can pass through the holes 17. When this occurs, the coins are supported on a supporting board 10 and are moved by the reverse face of the rotating disc 14.

The coins 2 can contact a control pin (not shown) on the supporting board 10 and can subsequently be dispensed from the dispensing slot 21 at a predetermined position. These features are known in the prior art and the coins are counted up to the predetermined number as they are being dispensed.

As shown in FIGS. 2, 3, 4, and 7, the storing bowl 5 includes a base bowl 22 adjacent the coin dispenser 9 and an upper larger bowl 23. The base bowl 22 is cylinder-like in shape and is fixed at the supporting board 10 and encloses the rotating disc 14. The upper bowl 23 is rectangular and cylinder-like in shape and is fixed at its upper opening portion 24 to the base bowl 22. The base bowl 22 is cylindrical in configuration with a base that includes base 25 and opening 24 on the upper sidewall to enclose the rotating disc 14 by the base 25. Base 25 is further supported on the supporting board 10 so that the bottom surface 26 of the base bowl 22 is slanted parallel to the rotational axis line of the rotating disc 14. The degree of slant is enough to permit coins 2 to slide to the side of the rotating disc 14 on the bottom surface 26 by gravity.

Figure 10:
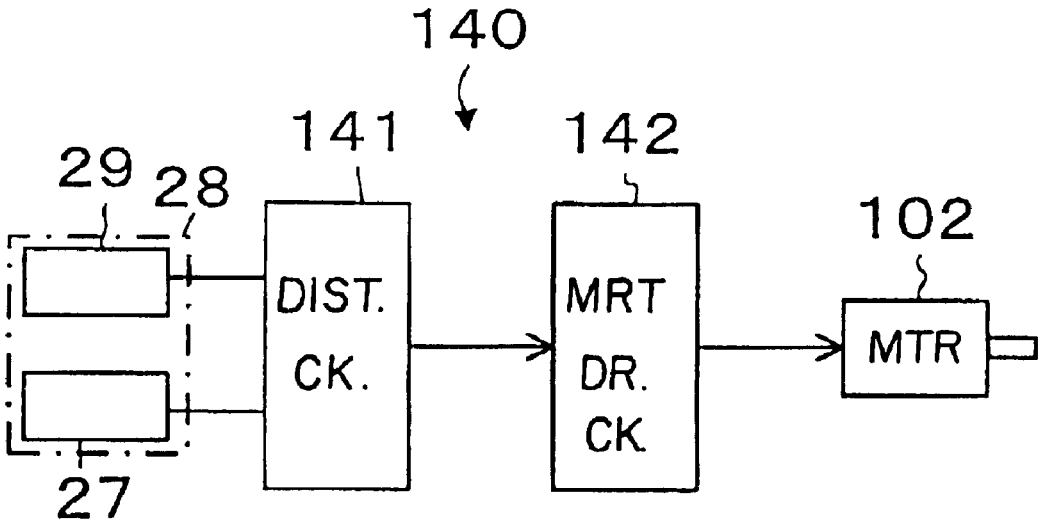
FIG. 10 is a control block diagram of the present invention.

As shown in FIG. 7, a bottom electrode 27 can act as a coin amount sensor 28 as to be further disclosed with regards to FIG. 10. The coin sensor 28 is fixed at the bottom surface 26 near the rotating disc 14. A complementary upper electrode 29 is similar to the bottom electrode 27 and is fixed on an upper portion of the sidewall of base bowl 22.

When a sufficient number of coins are stored in the base bowl 22, the height of the coins will permit an electrical current to flow between the electrodes 27 and 29 to provide an indication of the number of coins currently within the base bowl 22.

Figure 4:
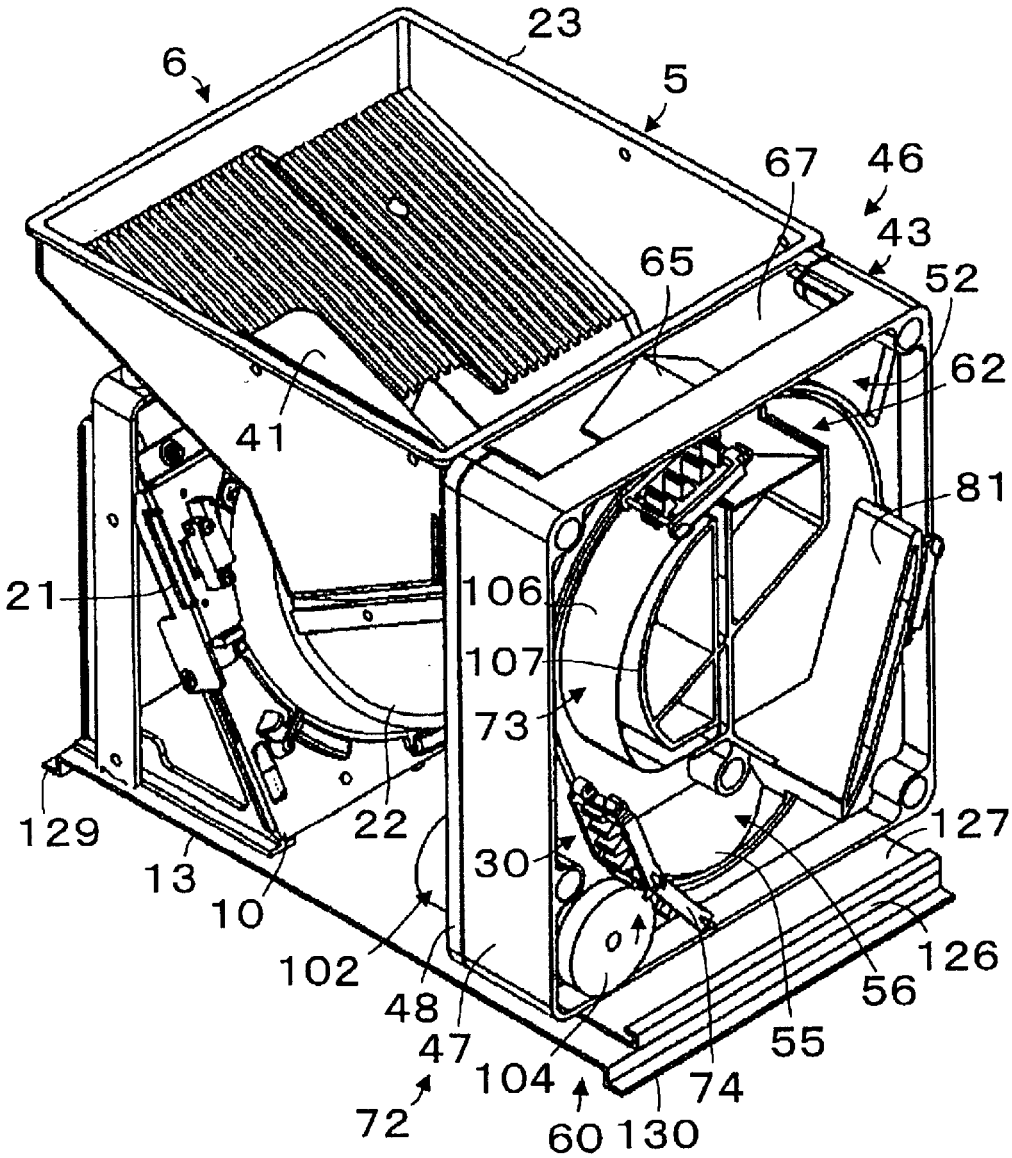
FIG. 4 is a perspective view of the coin dispensing apparatus with the cover member of the auxiliary bowl assembly removed.

Referring to FIG. 4, a coin transporter unit 30 can be activated in an auxiliary bowl assembly 43 when the current flow is interrupted between the bottom electrode 27 and the upper electrode 29.

The upper bowl 23 includes a first slanting surface 31 which is located above the rotating disc 14, a second slanting surface 32 and a third slanting surface 33. The bowl 23 is funnel-like in shape with its upper opening having a rectangular configuration. Coins can be deposited within this coin entry opening 34.

The lower section of the upper bowl 23 has an exit opening 35 which is also rectangular-like in shape. The lower section of the upper bowl 23 is inserted into the opening 24 of the lower base bowl 22 and is fixed.

Figure 8:
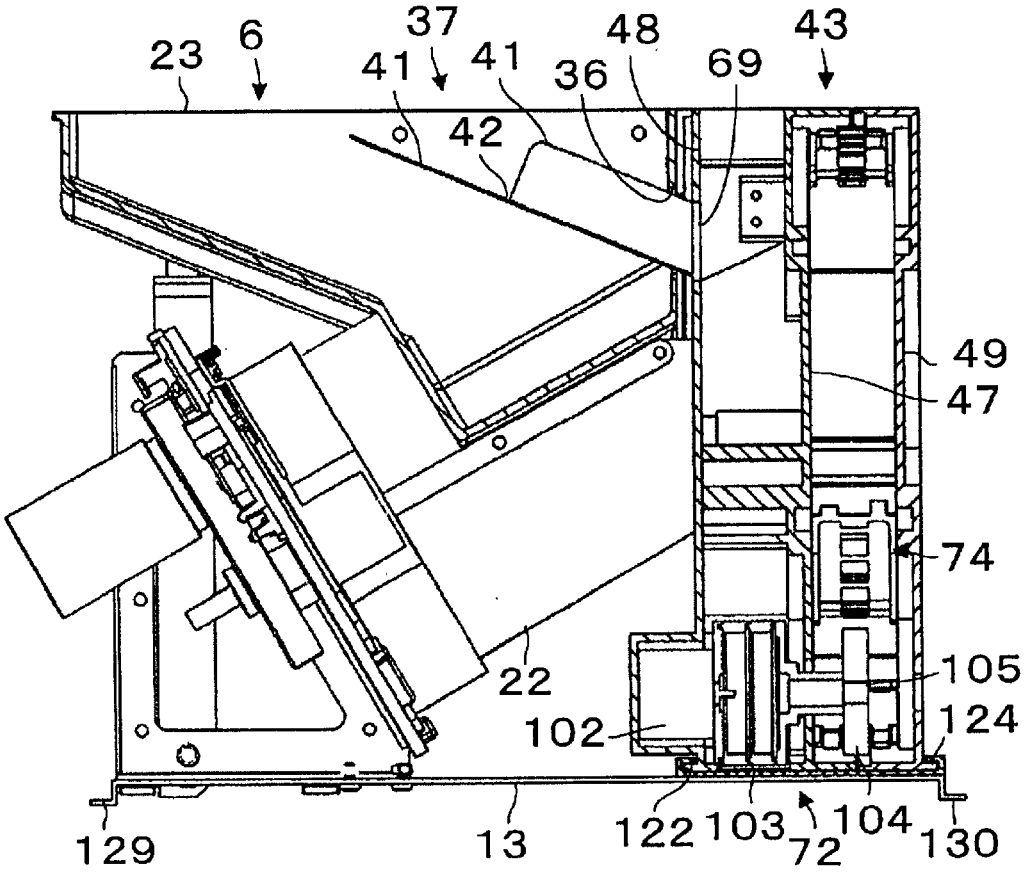
FIG. 8 is a cross-sectional view taken along the line y—y of FIG. 5.

An overflow opening 36 is located at the upper wall of the upper bowl 23 and faces towards the rotating disc 14 (as shown in FIG. 2). This arrangement provides an overflow chute 27 fixed at the sidewall of upper bowl 23. The chute 37 has a u-shaped like configuration and is inclined sufficiently to permit coins to slide down the bottom board 38 between the sidewalls 39 and 40. The bottom board 38 slants towards the overflow exit 36 to permit coins to be introduced into the auxiliary bowl assembly 43. The upper end of this chute 37 is located adjacent the top of the bowl 23 (as shown in FIG. 8) thereby providing an opening 42 so that a coin 2 can pass through the opening as it moves along the chute 41.

Referring to FIG. 7, the auxiliary bowl assembly 43 includes a first auxiliary storing section or cavity 44, a second auxiliary storing section 45, and a coin recycling device 46. As can be seen in FIG. 2, the auxiliary bowl assembly 43 has a rectangular box-like shape and includes a housing 47 (shown in FIG. 7), a first cover 48, and a second cover 49.

Figure 3:
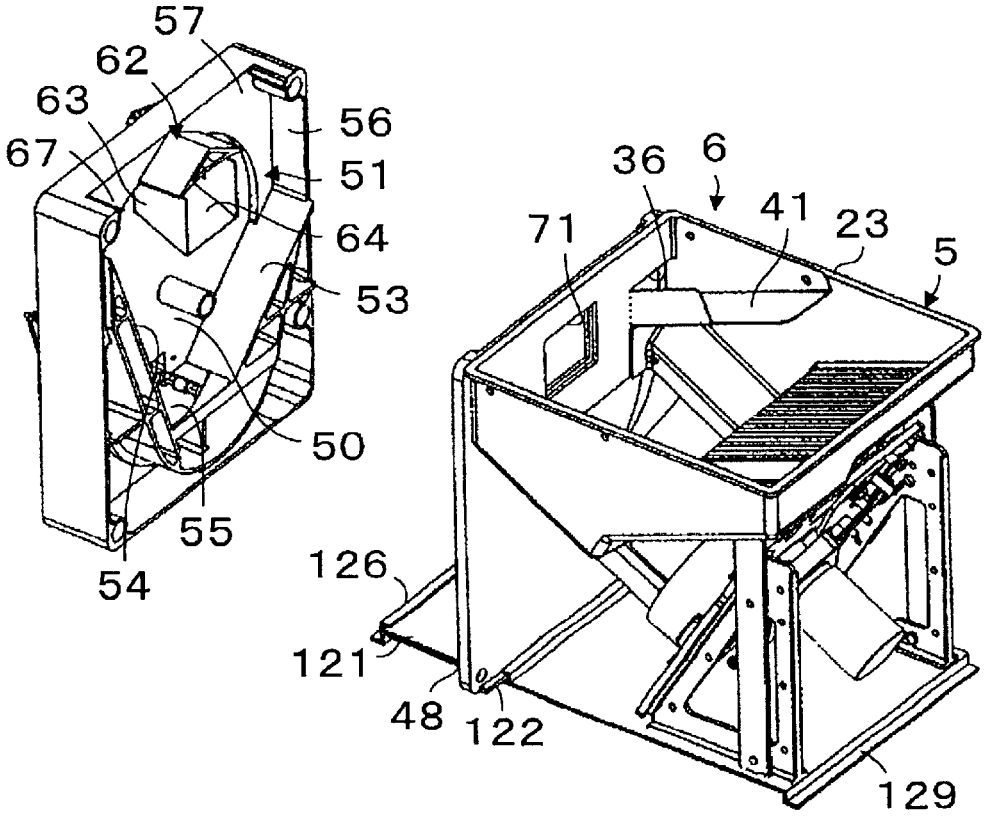
FIG. 3 is a exploded perspective view of the coin dispensing apparatus.

Referring to FIGS. 3, 4, and 7, the housing 47 includes a bulkhead 50 located at the center of the housing 47. The bulkhead 50 has a first depressed portion 51, which is located at the side of the storing bowl 5, and a second depressed portion 52, which is located at the opposite side of hopper 6.

The first depressed portion 51 is framed in by first guiding slant 53, second guiding slant 54, third guiding slant 55, and the first vertical plane 56. The first guiding slant 53 is straight and is located below the overflowing exit 36 (as shown in FIG. 3).

A second depressed portion 52 is located across from the first guiding slant 53, the third guiding slant 55 is continued below the lower section of the first guiding slant 53, and the lower section of the second guiding slant 54. The first vertical plane 56 extends to the top section of the first guiding slant 53.

The configuration of the first guiding slant 53, second guiding slant 54, and third guiding slant 55, together makes a v-like shape. The third guiding slant 55 is located at the lower section of through hole 57 in bulkhead 50.

Figure 5:
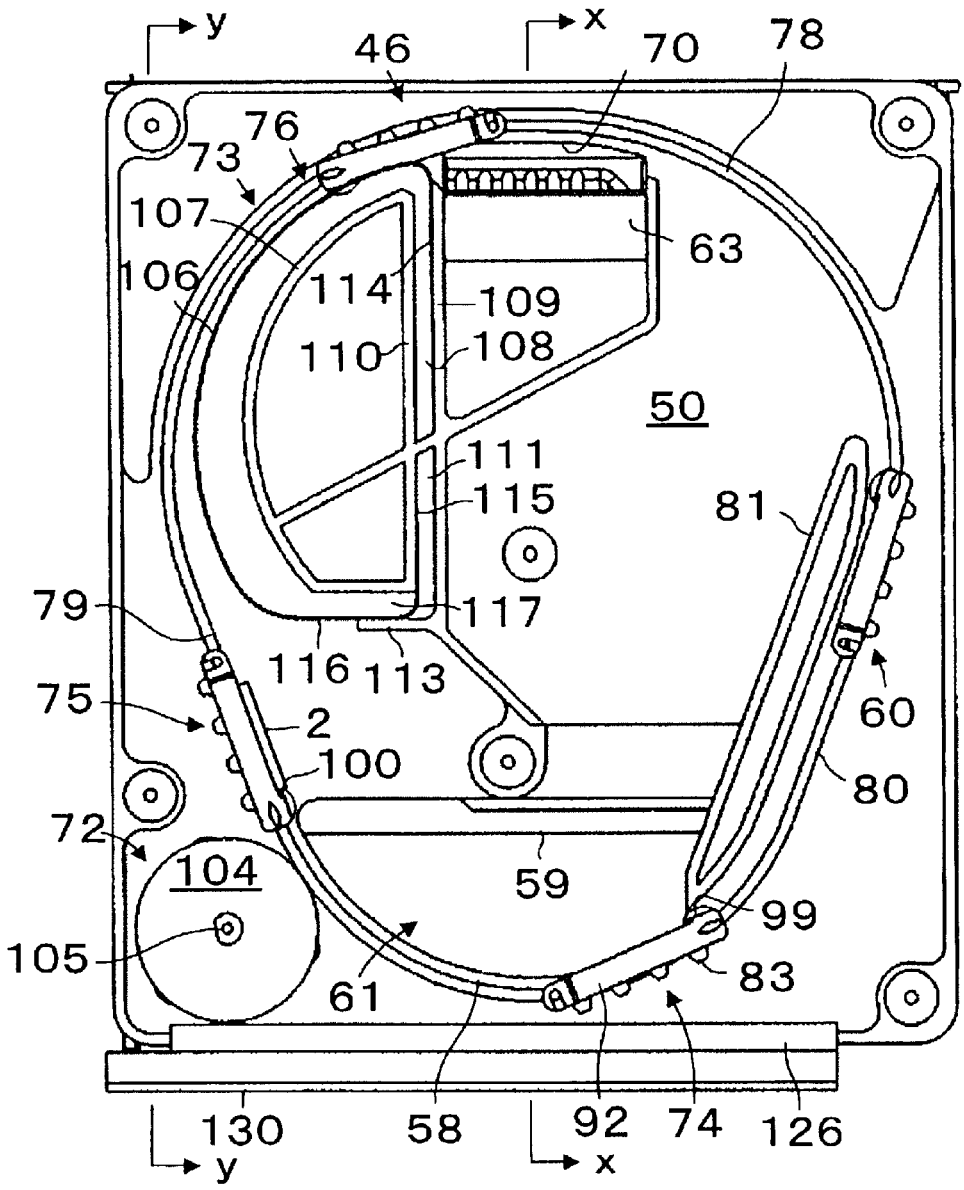
FIG. 5 is a front elevational view of the auxiliary bowl member with the cover removed.

As shown in FIG. 5, the lower edge of the through hole 61 is curved and it continues upward to match the guiding groove 76. The upper edge of the through hole 61, in other words, the lower section 59 of the bulkhead 50, is level and straight. The third slant 55 permits coins to roll downward by gravity towards to the storing bowl 5 and the rotating belt or endless loop member 60.

A coin transporter unit or coin recycling device 46 includes the upper delivery device 62 for delivering coins through an aperture 71 to the coin hopper and the transporting device 30. Referring to FIGS. 3–5 and 7, the delivery device 62 is located at the upper section of a first depressed portion 51. The delivery device includes a chute 63 which is rectangular in cross section. The delivery device crosses the first depressed portion 51 and second depressed portion 52. A bottom surface 64 slants from the second depressed portion 52 to the first depressed portion 51 so that coins that are dropped on the bottom 64 slide off by gravity.

The upper section of the side of the first depressed portion 51 is closed by a guide 65 which is triangular in cross section. Any coin that enters is guided smoothly to the first passage 66 or the second passage 67 by the guide 65 because guide 65 is triangular in shape. Therefore, the first passage 66 is made up of the area between the chute 63 and the first vertical wall 56 and the second passage 67 is made up between the chute 63 and the second guiding slant 54. A first cover 48 is fixed adjacent to first depressed portion 51 and is fixed at the housing 47 by screws and covers the first passage 66 and the second passage 67.

A first auxiliary storing section 44 is considered to be the area which is framed in by the first guiding slant 53, the second guiding slant 54, and the third guiding slant 55. The opening 69 (as shown in FIG. 8) is located at the first cover 48 to be adjacent or opposite to the overflow opening 36. A rectangular opening 70 is formed in a section of the first cover 48 opposite to the opening of the chute member 63. Opening 71 (as shown in FIG. 2), is formed in a section of the bowl 23 opposite to the opening 70.

Figure 6:
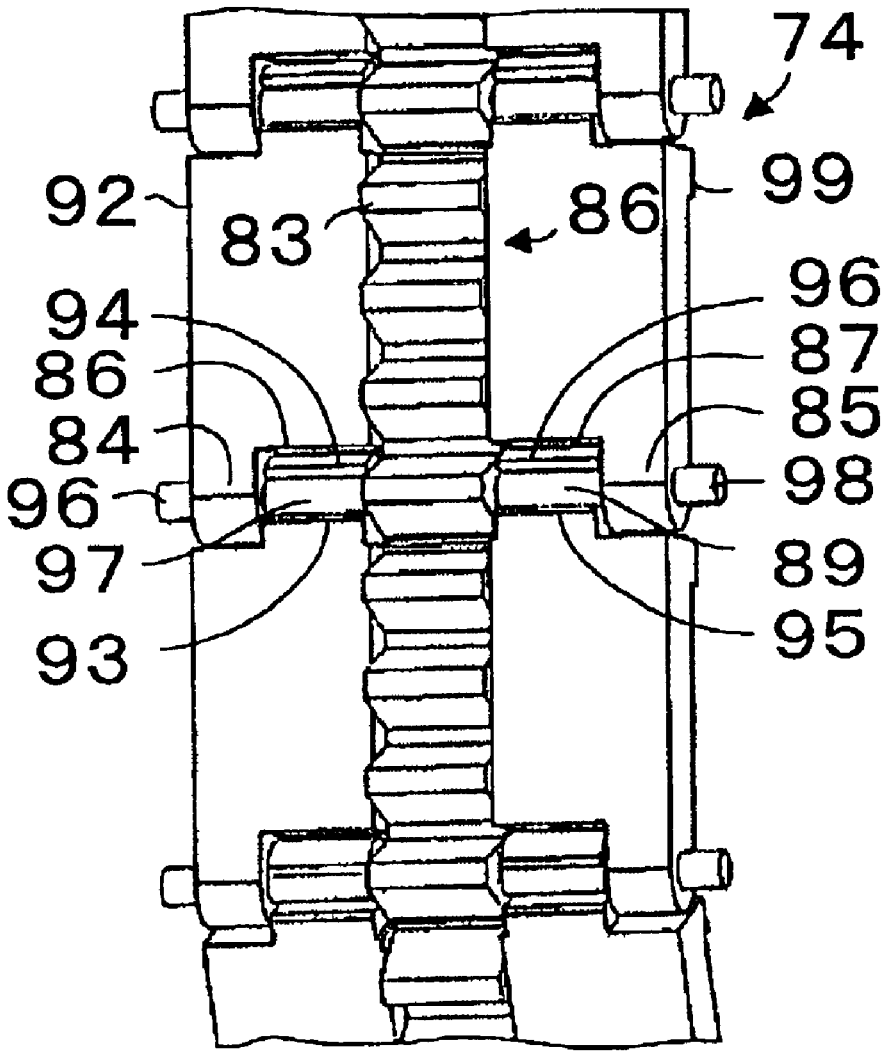
FIG. 6 is a partial perspective view of the portion of the coin transporting endless loop member.

The upper transporting device is located adjacent the second depressed portion 52 and includes a rotating belt 60, a driver 72 for engaging the rotating belt 60, and a supporting device 73. The rotating belt 60 has a crawler configuration and a portion of the belt is shown in FIG. 6. The crawler device 75 includes the crawler 74 which is made up of a plurality of individual pivoting blocks.

The individual crawler or blocks can be molded from an injection molded plastic and can be pivotally connected together. As shown in FIG. 6, four rack teeth 83 are positioned on the center of the outer surface of a crawler block 92. A first support member 84 and a second support member 85 protrude from both side surfaces of the crawler block 92. Also, a first depressed section 86 and a second depressed section 87 are provided on both sides of the rack teeth 83. A first contacting bar 87 having a round shaft is located in the first depressed section 86, which is between the end of the first supporter 84 and the end of the rack teeth 83. A second contacting bar 89 is also a round shaft and is located in the second depressed section 84. The first connector 94 and second connector 96 protrude from both side surfaces of the crawler block 92. The first connecting groove 93 is u-shaped and is opened outwards and is made up of the end of the first connector 94. Also, the second connector groove 95 is u-shaped and is opened outward and made up of the end of the second connector 96.

A first guide pin 96 protrudes from the first supporter 84 and extends on the line of the first connecting bar 97. A second guide pin 98 protrudes from the second supporter 85 and is also located on an extended line of the second connecting bar 89. As shown in FIG. 5, a ledge or projection member 99 protrudes inside of the crawler 74 from the lower section of the crawler block 92. The length of the projection 99 is smaller than the thickness of a coin and it crosses through the line of rack teeth 83 and is the same width as the crawler block 92.

The upper surface of projection 99 is a structure for providing a coin mounting surface 100 at the first slanting section 79. As a result, only one coin is mounted on the projection 99 at the first slanting section 79.

Crawler 74, which makes up the endless loop member, can be made up of a number of crawler blocks 99 which are chained or linked together to have a predetermined length. The first connecting bar 97 is inserted into the first connecting groove 93 and the second connecting bar 89 is inserted into the second connecting groove 95.

The predetermined length of crawler 74 will be determined on the number of crawler blocks 92 that are required for the particular size of auxiliary bowl member. The rack teeth 84 form a rack 86 on the outer surface to permit the driving of the endless loop member. The guiding pins 96 are inserted into a first guiding groove 76, while the second guiding pins 98 are inserted into a second guiding groove 77. The second cover 49 is fixed at the housing 47 by screws. The second auxiliary storing space 45 is made of up of the first guiding plate 59, the undersurface of the crawler 74, and second cover 79. This storing space faces the coin through hole 56. The first guiding groove 76 extends around the bulkhead 50 and the second guiding groove 77 extends around the second cover 49.

Referring to FIG. 5, the first guiding groove 76 is oval and is made up of the bulkhead 59 of the second depressed section 52. The first guiding groove 76 includes the upper curved section 78, lower curved section 58, which has a smaller curvature, the first slanted section 79 that connects with the curved sections, and a second slanted section 80. The upper section of the curved section 78 is located above the chute member 63. The lower section of the curved section 58 is located below the lower end of the third slanted plane.

The first guiding board 81 is located in the first guiding groove 76 and separates any inadvertently lodged coins 2 on the crawler which it moves downward.

Referring to FIG. 7, the second guiding groove 77 is made up of the inside face of the second cover 49 opposite to the first guiding groove 76 and is of the same shape as the first guiding groove 76. Thus, when the second cover 49 is fixed to the housing 47 by screws or other fasteners, the crawler member 74 is captured between the cover members and is designed to receive coins on the inner radial surface so that the projection 99 can lift the coins 2 as shown in FIG. 2.

The endless loop member or crawler 74 is driven by a driving device 72 (as shown in FIGS. 4, 5, and 8). The driving device 72 is fixed at the bottom of housing 47 and includes a second motor 102, a reducing gear 103, and a driving gear 104. The driving shaft 105 of the reducer 103 is located in the second depressed section 52 and passes through the bulkhead 50 of housing 47. Driving gear 104 is fixed on the driving shaft 105 and is engaged with the rack 46 of the crawler 74. A counter-clockwise rotation of the driving gear 104 causes the crawler 74 to move in a counter-clockwise direction.

Referring to FIGS. 4 and 5, a supporting structure for the crawler and coin interface is disclosed. The supporting device 73 includes a supporting board 106 which is located near the left inside surface of the upper curve 78 and has a D-shaped configuration. The supporting device has elastic properties. The D guide 107 extends from the bulkhead 50 towards the upper curve 76. The first supporting groove 108 is made up of the second guide 109 which is located along a second vertical wall 110 of the D guide 107 and extends upward. A second supporting groove 111 is made up between the lower section of D guide 110 and second guide 109.

Third supporting groove 112 is made up by third guide 113 which is located along the lower edge of D guide 107 and is level. First end 114 extends in the vertical direction at the upper section of supporting board 106 and is inserted in first supporting groove 108. Second end 115 extends in the vertical direction at the lower section of supporting board 107 and is inserted in second supporting groove 111. Middle section 116 continues to second end 115 and is located at third supporting groove 112. In normal operation, first end 114 of supporting board 106 has contact with second guide 109 and second end 115 has contact with second vertical wall 110 of D guide 107 and middle section 116 has contact with third guide 113 and the projection has contact with the inner surface of crawler 74. The upper end of supporting board 106 is located near chute 63. Supporting board 114 prevents the coins dropping from crawler 74 before the coins are transferred to chute 63.

A position changing device 120 permits a change in position between the coin hopper 6 and the auxiliary bowl 43. Therefore, auxiliary bowl 43 can slide relative to coin hopper 6. Position changing device 120 includes first mounting device 121 (seen in FIG. 7). First guiding block 122 is located at the lower section of first cover 48 and extends towards a level position. Second guiding block 122 is located at the lower section of second cover 49 and also extends towards a level position. Stopper 123 (shown in FIG. 9) is positioned at the end of the second guiding block 124 and extends upward. First guiding block 122 and second guiding block 124 are located at both sides of the lower section of auxiliary bowl 43. Holder 124 has a first holding channel 125 and a second holding channel 126 which can move sideways and are fixed on base 13 adjacent to coin hopper 6. First guiding block 122 is inserted into the first holding channel 125 and a second guiding block 124 is inserted into the second guiding channel 126. First guiding block 122 and second guiding block 124 can move sideways toward stopper 123. In this situation, overflow opening 36 faces the opening 69 of first cover 48 and the end of chute 63 faces the opening 71 of bowl 23.

Second mounting device 128 is seen in FIG. 7. Third guiding block 129 is bent from the left end of base 13 and extends towards a level position. Fourth guiding block 130 is bent at a right angle on base 13 and is then extended level. First holding block 131 is crank-like in shape and is fixed on base 132 of a gaming machine. As a result, a third holding channel 133 is formed. Second holding block 134 is fixed on base 132 of a gaming machine. As a result, a fourth holding channel 135 is formed. Third guiding block 129 is inserted into third holding channel 133 and the fourth guiding block 130 is inserted into fourth holding channel 135. Hopper 6 and the auxiliary bowl assembly 43 can slide into and out of gaming machine on base 13.

Control block circuit 140 for the second motor 102 is explained by referring to FIG. 10. Bottom electrode 27 and upper electrode 29 are connected to a distinguishing circuit 141. If the current flows between bottom electrode 27 and upper electrode 29, the distinguishing circuit 141 will output a normal signal. If a current is not recognized between bottom electrode 27 and upper electrode 29, distinguishing circuit 141 outputs a defect signal. Motor driving circuit 142 will drive the second motor 102 as long as it receives a defect signal.

Coins are entered into upper bowl 23 and base bowl 22 over the upper electrode 29. Auxiliary bowl 43 is positioned adjacent the upper bowl 23 and can be used to store additional coins. In this situation, the coins are provided to first auxiliary bowl 43 through first passage 66 or second passage 67. A coin 2, which enters at coin slot 2 of gaming machine, is sent to upper bowl 23.

When the coins become greater than the necessary quantity of the pay out coins, coins 2 in upper bowl 23 will move into the overflow chute 37. Coins 2 slide on bottom board 38 and pass through overflow opening 36 and opening 69 and drop on first guiding slanting surface 53 and arrive at the third slanting surface 55. Coins 2 will slide down the third slanting surface 55 and arrive on a crawler 74. As a result, coins 2 are stored in second storing section 45 on crawler 74. Coins 2 continue to drop on to crawler 74, and then are piled up higher than the lower edge 59 of coin passage 56. However, coins 2 can not move towards the side of crawler 74 because of bulkhead 50. As a result, coins 2 are stored in first storing section 44. Therefore, coins 2 will not pile up over the lower end 59 and as a result, the weight of coins is limited on crawler 74, and the moving friction is small. Coins 2 slide down first guiding slanting surface 53. Therefore, the crawler does not receive damage by the coins dropping down, and as a result, the crawler has a long life.

When a dispensing signal is outputted from gaming machine 1, first motor 16 rotates and rotating disc 14 is rotated by reducer 19. Coins 2 are agitated by the rotation of rotating disc 14 and change position. When coin 2 becomes parallel to rotating disc 14, a coin 2 drops through holes 17. Afterward, coin 2 is supported on supporting plate 10, and is moved by a pushing tooth (not shown) on the reverse face of the rotating disc and is dispensed from dispensing slot 21 by a known propelling device. Coins 2 on bottom 26 slide downward and arrive on rotating disc 14 and are dispensed from dispensing slot 21.

Coins 2 on first slanting surface 31, second slanting surface, and third slanting surface 33 of increasing bowl 23 slide downward by gravity. When coins 2 are stored lower than the upper electrode 29, the current does not flow between upper electrode 29 and bottom electrode 27. As a result, a distinguishing circuit 141 detects this condition and second motor 102 is rotated by motor driving circuit 142.

Crawler 74 moves in a clockwise direction through the reducer 103, outputting shaft 105, driving gear 104 and rack 86 by the rotation of the second motor 102 (as shown in FIG. 5). When crawler 74 is moving, coin 2 has contact with a projection 99 on a crawler block 92 and is pushed up at first slanting section 79. Coin 2 does not drop down at first slanting section 79, because coin 2 is borne to crawler block 92. When crawler 74 moves from first slanting section 79 to upper curved section 76, coin 2 is further supported by supporting plate 106 before the coin 2 becomes in a vertical position. As a result, coin 2 is pressed to crawler block 92 by supporting plate 106 and does not drop downward. When coin 2 is nipped between crawler 92 and supporting plate 106, middle section 109 of supporting plate 106 flexes and moves towards the right along third guide 113. Middle section 109 is bent to push coin 2 to crawler 92. When coin 2 is pushed upward, the distance between crawler 74 and supporting plate 106 becomes narrow. As a result, the coin 2 also is pressed to crawler 92 by supporting plate 106. Supporting plate 106 continually supports coin 2, because the upper end is bent downward in first supporting groove 108. When coin 2 passes through supporting plate 106, coin 2 is located over chute 63. In this situation, coins 2 are not supported by supporting plate 106. Therefore, coins 2 drop in chute 63 and slide downward and pass through opening 70 and 71 and arrives in upper bowl 23. Second motor 102 rotates continuously until a current flows between upper electrode 29 and bottom electrode 27.

Figure 9:
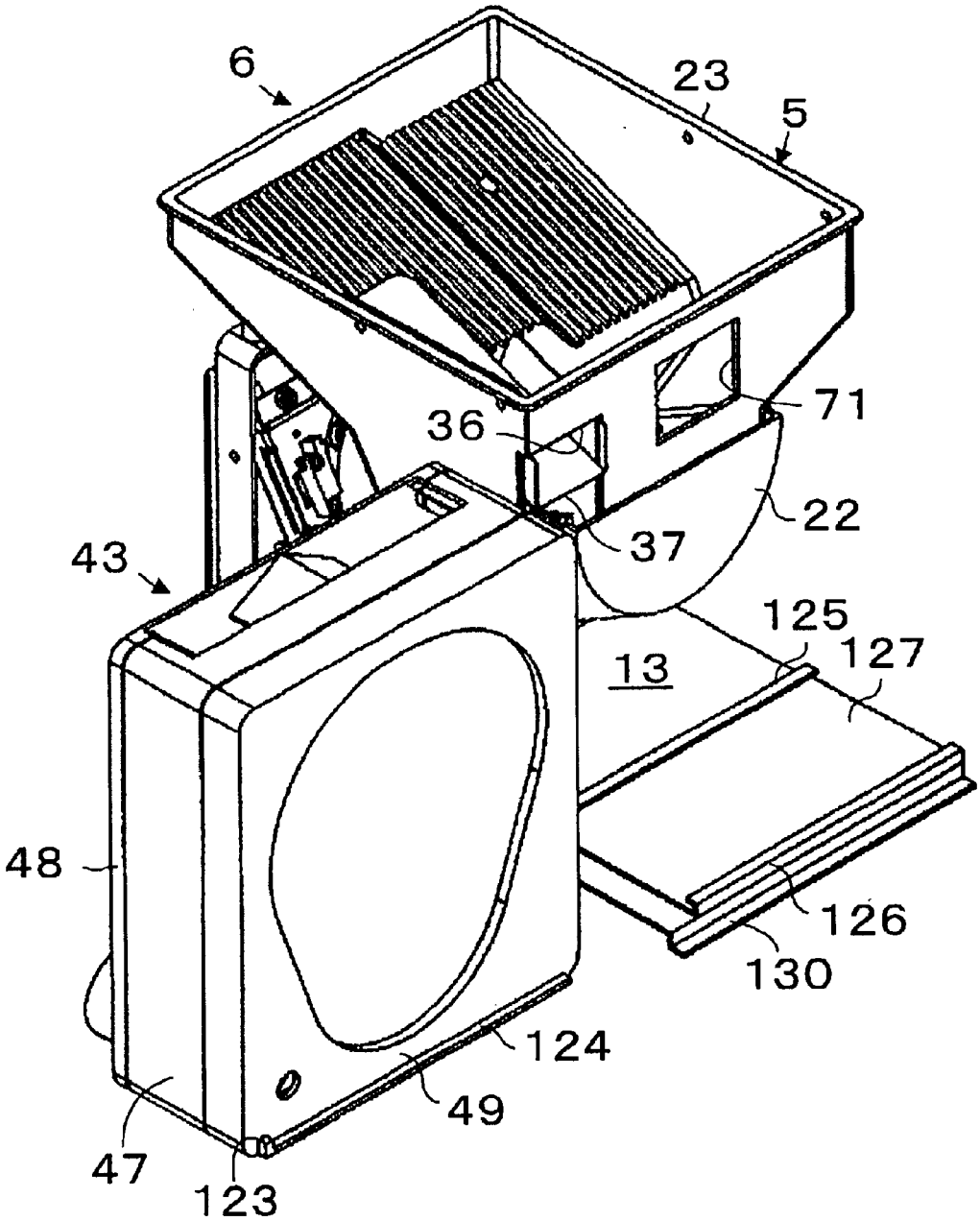
FIG. 9 is a perspective view with the auxiliary bowl member removed.

A coin redemption operation from hopper 6 and auxiliary bowl 43 is now explained. The front door of gaming machine 1 is opened. Base 13 is pulled out from the gaming machine along third supporting channel 133 and fourth supporting channel 135. In this situation, coins 2 are taken out from upper bowl 23 and base bowl 22. Next, auxiliary bowl 43 is pulled out from first mounting device 121 along first supporting channel 125 and second supporting channel 126 and is detached (as shown in FIG. 9). Next, auxiliary bowl 43 is inverted to drop coins 2 from first auxiliary section 44 and second auxiliary section 45. Coins 2 are redeemed and afterward first guiding block 122 is inserted in first supporting channel 125 and second guiding block 124 is inserted in second supporting channel 126 and is moved as stopper 123 has contact with second supporting channel 126. Next, base 13 is moved into gaming machine 1, and afterwards, the front door is closed.

Another example would have only auxiliary bowl 43 pulled out from gaming machine 1 and transporting device 30 is moved by second motor 102. Coins 2, which are dropped from opening 70, can be redeemed.

This present invention can be modified. For example, the upward transporting device 30 can be made by a shaft with a spiral. The shaft with a spiral can rotate around a shaft axis line. The coins would be held between the spiral member and be transported upward to the delivery device. Also, the upward transporting device 30 could be made by a rotating disc and a passage which is a cross section of a rectangle. The coins are dispensed into the passage by the rotating disc and are arrayed and are pushed upward. Auxiliary bowl 43 can be locked to a first mounting device 121 or base 13 by a locking device. Also, the base can be locked to gaming machine 1 by a locking device. The rotating disc can be made by a rotating disc with pins which are located at predetermined intervals and are fixed onto the rotating disc. The coin volume sensor can be an optical sensor which detects the quantity of coins in base bowl 22.

Those skilled in the art will appreciate that various adaptations and modifications of the just described preferred embodiments can be configured without department from the scope and spirit of the invention. Therefore, it is to be understood that, within the scope of the appended claims, the invention may be practiced other than as specifically described herein.

What is claimed is:

1. A coin dispensing apparatus comprising:

a coin hopper for storing coins;

a coin dispenser operatively connected to the coin hopper for selectively dispensing coins from the coin hopper;

an auxiliary bowl assembly for receiving overflow coins from the coin hopper and returning coins to the coin hopper; and a position adjusting device for removably mounting the auxiliary bowl assembly to enable an operative position adjacent the coin hopper.

2. The coin dispensing apparatus of claim 1 wherein the auxiliary bowl assembly includes a guiding groove, and an endless loop member includes guide pins for engaging the guiding groove to return coins from the auxiliary bowl assembly to the coin hopper.

3. The coin dispensing apparatus of claim 2 further including an exit chute on the auxiliary bowl assembly and a complimentary aperture on the coin hopper for accepting coins from the exit chute.

4. The coin dispensing apparatus of claim 3 wherein the position adjusting device includes a channel and rail to permit a sliding movement of the auxiliary bowl to an operative position adjacent the coin hopper.

5. The coin dispensing apparatus of claim 1 wherein the auxiliary bowl assembly includes a flexible support member for supporting the endless loop member.

6. A coin dispensing apparatus comprising:

a coin hopper for storing coins;

a coin dispenser operatively connected to the coin hopper for selectively dispensing coins from the coin hopper;

an auxiliary bowl assembly for storing coins, including a coin transporter unit, for removing coins from the auxiliary bowl assembly and transporting the coins to the coin hopper having a plurality of block members pivotally connected to form an endless loop member for transporting coins, one side of each block has indentations that can be driven and the other side has a coin engaging surface.

7. The coin dispensing apparatus of claim 6 wherein the auxiliary bowl assembly includes a guiding groove, and the endless loop member includes guide pins for engaging the guiding groove.

8. The coin dispensing apparatus of claim 6 further including an exit chute on the auxiliary bowl assembly and a complimentary aperture on the coin hopper for accepting coins from the exit chute.

9. The coin dispensing apparatus of claim 6 further including a position adjusting device for removably mounting the auxiliary bowl assembly to enable an operative position adjacent the coin hopper.

10. The coin dispensing apparatus of claim 9 wherein the position adjusting device includes a channel and rail to permit a sliding movement of the auxiliary bowl to an operative position adjacent the coin hopper.

11. The coin dispensing apparatus of claim 10 wherein the auxiliary bowl assembly includes a flexible support member for supporting the endless loop member.

* * * * *